US007771565B2

(12) United States Patent
Kirov et al.

(10) Patent No.: US 7,771,565 B2
(45) Date of Patent: Aug. 10, 2010

(54) METHOD OF PRE-TREATING WOODCHIPS PRIOR TO MECHANICAL PULPING

(75) Inventors: Ventzislav H. Kirov, Lake Bluff, IL (US); Anil Sethy, Glenview, IL (US); Bryan L. Sorensen, Gages Lake, IL (US)

(73) Assignee: Packaging Corporation of America, Mundelein, IL (US)

( * ) Notice: Subject to any disclaimer, the term of this patent is extended or adjusted under 35 U.S.C. 154(b) by 319 days.

(21) Appl. No.: 11/358,594

(22) Filed: Feb. 21, 2006

(65) Prior Publication Data

US 2007/0193706 A1 Aug. 23, 2007

(51) Int. Cl.
*D21B 1/16* (2006.01)
*D21B 1/12* (2006.01)

(52) U.S. Cl. ..... 162/24; 162/23; 162/26

(58) Field of Classification Search ..... 162/72, 162/90, 23, 24, 26
See application file for complete search history.

(56) References Cited

U.S. PATENT DOCUMENTS

| | | | | |
|---|---|---|---|---|
| 2,904,460 | A | 9/1959 | Nolan | |
| 3,202,569 | A | 8/1965 | Coggan et al. | |
| 3,617,431 | A | 11/1971 | Liss-Albin | |
| 3,632,469 | A * | 1/1972 | Wilder | 162/25 |
| 3,932,207 | A | 1/1976 | Fogarassy | |
| 3,954,553 | A | 5/1976 | Dillard et al. | |
| 3,981,765 | A | 9/1976 | Kruger et al. | |
| 4,045,279 | A | 8/1977 | Nagano et al. | |
| 4,229,251 | A | 10/1980 | Temler | |
| 4,248,662 | A | 2/1981 | Wallick | |
| 4,436,586 | A | 3/1984 | Elmore | |
| 4,470,851 | A | 9/1984 | Paszner et al. | |
| 4,486,267 | A | 12/1984 | Prusas et al. | |
| 4,548,675 | A | 10/1985 | Gordy | |
| 4,599,138 | A | 7/1986 | Lindahl | |
| 4,634,499 | A | 1/1987 | Ampulski | |
| 4,734,162 | A | 3/1988 | Ampulski | |
| 4,787,959 | A | 11/1988 | Lachenal et al. | |
| 4,941,944 | A | 7/1990 | Chang | |
| 4,997,091 | A | 3/1991 | McCrea | |

(Continued)

FOREIGN PATENT DOCUMENTS

| | | |
|---|---|---|
| EP | 0 284 585 | 9/1988 |

(Continued)

OTHER PUBLICATIONS

Gullichsen et al., Chemical Pulping 6A,1999, Fapet Oy, p. A559.*

(Continued)

*Primary Examiner*—Eric Hug
*Assistant Examiner*—Anthony J Calandra
(74) *Attorney, Agent, or Firm*—Nixon Peabody LLP

(57) ABSTRACT

A method of making pulp adapted to be used in forming corrugating medium is disclosed. The method comprises cooking woodchips in a first liquor in the absence of an alkali addition. The method further comprises mechanically fiberizing the woodchips to form a pulp. The method further comprises separating hydrolyzate from the pulp. The method further comprises treating the pulp with a second liquor, the second liquor including at least one alkali. The method further comprises refining the pulp.

42 Claims, 2 Drawing Sheets

U.S. PATENT DOCUMENTS

| | | | | |
|---|---|---|---|---|
| 4,997,488 | A | 3/1991 | Gould et al. | |
| 5,096,540 | A | 3/1992 | Sell et al. | |
| 5,248,389 | A * | 9/1993 | Heimburger et al. | 162/76 |
| 5,250,153 | A | 10/1993 | Izard et al. | |
| 5,413,677 | A | 5/1995 | Collins | |
| 5,522,958 | A | 6/1996 | Li | |
| 5,656,733 | A | 8/1997 | Suchanec | |
| 5,766,159 | A | 6/1998 | Martin et al. | |
| 5,879,510 | A * | 3/1999 | Hagglund et al. | 162/25 |
| 5,902,454 | A | 5/1999 | Nelson | |
| 5,925,218 | A | 7/1999 | Ogden | |
| 5,967,769 | A | 10/1999 | Thompson | |
| 6,063,982 | A | 5/2000 | Martin et al. | |
| 6,214,164 | B1 | 4/2001 | Rantala | |
| 6,379,504 | B1 | 4/2002 | Miele et al. | |
| 6,464,832 | B2 | 10/2002 | Engelhardt et al. | |
| 6,509,180 | B1 * | 1/2003 | Verser et al. | 435/161 |
| 6,544,384 | B2 | 4/2003 | Henricson et al. | |
| 6,562,191 | B1 | 5/2003 | Rousu et al. | |
| 6,605,180 | B2 | 8/2003 | Snekkenes et al. | |
| 6,620,292 | B2 | 9/2003 | Wingerson | |
| 6,743,332 | B2 * | 6/2004 | Haynes et al. | 162/78 |
| 6,770,168 | B1 | 8/2004 | Stigsson | |
| 6,896,810 | B2 | 5/2005 | Ali et al. | |
| 6,923,888 | B2 | 8/2005 | Rousu et al. | |
| 6,955,743 | B2 | 10/2005 | Rousu et al. | |
| 7,540,938 | B2 * | 6/2009 | Munster | 162/47 |
| 2001/0032711 | A1 | 10/2001 | Stromberg et al. | |
| 2002/0139496 | A1 | 10/2002 | Hu et al. | |
| 2005/0087314 | A1 | 4/2005 | Stromberg et al. | |
| 2007/0051481 | A1 * | 3/2007 | Tan et al. | 162/17 |

FOREIGN PATENT DOCUMENTS

| | | |
|---|---|---|
| GB | 1 392 770 | 4/1975 |
| GB | 1434232 | 5/1976 |
| JP | 05-105426 | 4/1993 |
| JP | 08-209587 | 8/1996 |
| WO | WO 00/39390 | 7/2000 |
| WO | WO 00/47812 | 8/2000 |
| WO | WO 03046227 A1 * | 6/2003 |
| WO | WO 2004/050983 | 6/2004 |

OTHER PUBLICATIONS

Smook, Handbook for Pulp and Paper Technologists, 1992, Angus Wilde Publications, 2nd edition, Chapter 13 and 20.*

Hamilton et al., Pulp and Paper Manufacture: Secondary Fibers and Non-wood pulping, 1987, JTCPI, vol. 3, p. 83.*

Smook, Handbook for Pulp and Paper Technologists, 1992, Angus Wilde Publications, 2nd edition, p. 61 and 77.*

Gullichsen et al., Chemical Pulping 6A, 1999, Fapet Oy,p. A411-A416, p. A520-A521.*

McGovern, Experiments on Water and Steam Cooking of Aspen, 1949, TAPPI, vol. 32 No. 10, whole document.*

Smook, Handbook for Pulp and Paper Technologists, 1992, Angus Wilde Publications, 2nd edition, chapters 11 and 15.*

International Search Report for Application No. 07001629 dated Jul. 12, 2007.

Sven A. Rydholm, Pulping Processes, Interscience Publishers, p. 410-412 (1967).

* cited by examiner

METHOD OF PRE-TREATING WOODCHIPS PRIOR TO MECHANICAL PULPING

FIELD OF THE INVENTION

The present invention relates generally to a method of manufacturing pulp and, more particularly, to a method of manufacturing pulp used for making corrugating medium.

BACKGROUND OF THE INVENTION

A wall of a cardboard box or container generally includes a layer of corrugating medium positioned between thin sheets of linerboard, which form the outer plies. The corrugating medium forms the wavy center layer of the wall and may be used, for example, to cushion and/or protect item(s) inside the cardboard box or container. Corrugating medium is generally made from high yield hardwood pulps blended with recycled fiber such as old corrugating containers (OCC) or double-lined kraft clippings (DLK). Corrugating medium may also be produced from 100% recycled fiber furnish and/or post-consumer recycled fiber content without reducing its ability to protect an item(s) stored within the corrugating box or container.

The high yield hardwood pulps used in manufacturing corrugating medium may be produced using semichemical pulping processes including caustic carbonate pulping, neutral sulfite semichemical pulping (NSSC), and green liquor pulping. These existing processes initially use a liquor to cook the woodchips in a substantial amount of alkali to facilitate partial delignification and to minimize carbohydrate degradation. This is considered important or necessary for a corrugating medium manufactured from the pulp to possess desirable physical properties.

Accordingly, during the initial cooking stage of existing pulping processes, woodchips are placed into a digester(s) including a basic solution of alkali-containing cooking liquor. The weight percent of alkali (e.g., NaOH, $Na_2CO_3$, $Na_2SO_3$, $NaHCO_3$, $K_2CO_3$, $KHCO_3$, $NH_4OH$) on a bone dry wood basis generally ranges from about 4% to about 8% expressed as alkaline oxide (e.g., $Na_2O$). Bone dry wood is defined as moisture-free wood. The yield (the ratio of product output to raw material input) using these existing pulping processes generally ranges from about 70% to about 85%. The resultant pulp is then fiberized, pressed, and washed, thereby separating liquid filtrates (e.g., weak liquor) and solid filtrates from the pulp so that the pulp may be further refined. During the final refining stages, about 25% to about 50% recycled fiber is added to the pulp. The pulp is then formed into corrugating medium by a papermachine. The liquid filtrates separated from the pulp are evaporated, and the solid filtrates are burned in recovery boilers or fluidized bed reactors.

Vast amounts of capital, labor, and energy are generally expended to recover energy and chemicals associated with the significant amounts of alkali used during existing pulping processes. For example, it is desirable for the bulk of the alkali used during the initial cooking stage to be recovered from the liquid filtrates during a chemical recovery process and recycled back to the digester(s). The chemical recovery process generally includes evaporating excess water from the liquid filtrates to maximize the concentration of the recovered alkali, which requires significant amounts of energy. Furthermore, using large amounts of alkali may have detrimental effects on the environment.

It would be desirable to have a pulping process that assists in addressing one or more of the above disadvantages.

SUMMARY OF THE INVENTION

According to one method of the present invention, a method of making pulp adapted to be used in forming corrugating medium is disclosed. The method comprises cooking woodchips in a first liquor in the absence of an alkali addition. The method further comprises mechanically fiberizing the woodchips to form a pulp. The method further comprises separating hydrolyzate from the pulp. The method further comprises treating the pulp with a second liquor, the second liquor including at least one alkali. The method further comprises refining the pulp.

According to another method of the present invention, a method of making pulp adapted to be used in forming corrugating medium is disclosed. The method comprises cooking woodchips in a first liquor in the absence of an alkali addition. The method further comprises mechanically fiberizing the woodchips to form a pulp. The method further comprises separating hydrolyzate from the pulp. The method further comprises treating the hydrolyzate to remove at least one byproduct. The method further comprises treating the pulp with a second liquor, the second liquor including at least one alkali. The method further comprises refining the pulp.

According to another method of the present invention, a method of manufacturing a corrugating medium is disclosed. The method comprises cooking woodchips in a first liquor in the absence of an alkali addition. The method further comprises mechanically fiberizing the woodchips to form a pulp. The method further comprises separating hydrolyzate from the pulp. The method further comprises treating the pulp with a second liquor, the second liquor including at least one alkali. The method further comprises refining and deshiving the pulp. The method further comprises blending the pulp with recycled fibers to form a blended pulp. The method further comprises sending the blended pulp to a papermachine to form a corrugating medium.

According to another embodiment of the present invention, a method of manufacturing a corrugated board is disclosed. The method comprises cooking woodchips in a first liquor in the absence of an alkali addition. The method further comprises mechanically fiberizing the woodchips to form a pulp. The method further comprises separating hydrolyzate from the pulp. The method further comprises treating the pulp with a second liquor, the second liquor including at least one alkali. The method further comprises refining and deshiving the pulp. The method further comprises blending the pulp with recycled fibers to form a blended pulp. The method further comprises sending the blended pulp to a papermachine to form a corrugating medium. The method further comprises coupling the corrugating medium between a first outer ply and a second outer ply of linerboard to form a corrugated board.

The above summary of the present invention is not intended to represent each embodiment or every aspect of the present invention. The detailed description and Figure will describe many of the embodiments and aspects of the present invention.

Figure 1:
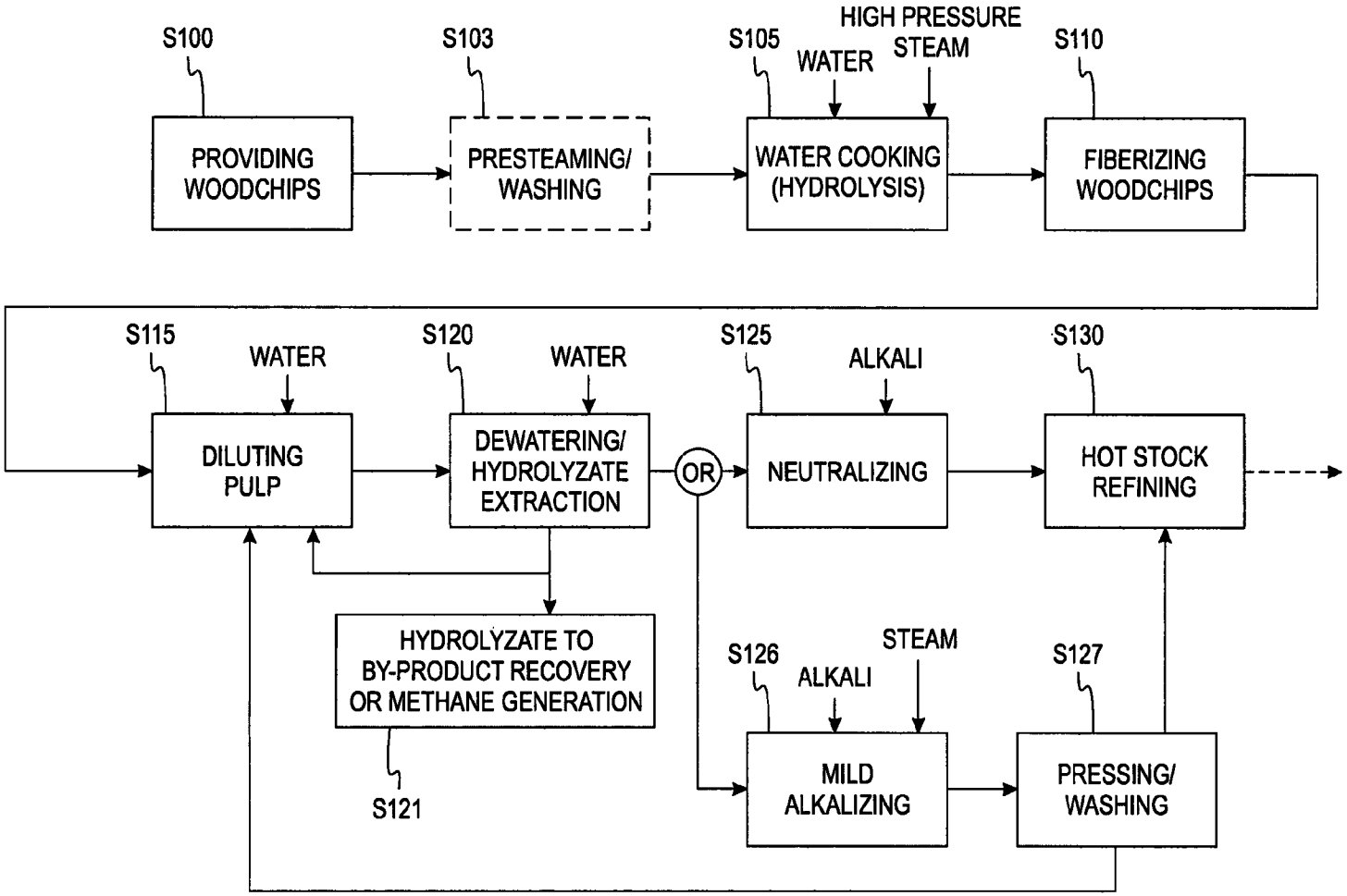
FIG. 1 is a flow diagram detailing a method of manufacturing pulp according to one method of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATED EMBODIMENTS

The present invention is directed generally to a method of manufacturing pulp and, more particularly, to a method of manufacturing pulp used for making corrugating medium. The inventive methods described herein generally produce a yield of about 70% to about 90%. Utilizing significant improvements in refining techniques and the use of recycled fiber, the present invention significantly simplifies and improves semichemical pulping processes by substantially reducing or eliminating the need to recover and recycle chemicals from cooking liquor.

Turning now to the drawings and initially to FIG. 1, a method of manufacturing pulp is detailed according to one embodiment of the present invention. In step s100, woodchips to be used in manufacturing pulp are provided. The woodchips may be a mixed-blend of wood from various species of hardwood, deciduous trees including, but not limited to, ash, aspen, beech, basswood, birch, black cherry, black walnut, butternut, buckeye, chestnut, cottonwood, dogwood, elm, eucalyptus, gmelina, hackberry, hickory, holly, locust, magnolia, maple, oak, poplar, red alder, redbud, royal paulownia, sassafras, sweetgum, sycamore, tupelo, willow, yellow-poplar, and combinations thereof. The woodchips may also comprise wood from various varieties of trees within the species of trees. It is contemplated that other species of hardwood, deciduous trees may be used. It is also contemplated that a single species of hardwood, deciduous trees may be used. The term "woodchips" as used herein may also include non-wood fibers including, but not limited to, bagasse, straw, kenaf, hemp, and combinations thereof. It is contemplated that woodchips may include wood from hardwood, deciduous trees in combination with non-wood fibers including those discussed above. The woodchips may be obtained from a woodyard, a woodroom, or the like.

At optional step s103, the woodchips may be pretreated such that a generally uniform penetration of the woodchips in various liquors may be obtained in later steps (e.g., initial cooking step s105). Pretreatment may include presteaming, pressurized impregnation, hot water washing, and/or combinations thereof. Presteaming and pressurized impregnation allow for a significant amount of air to be evacuated from the woodchips. It may be desirable to apply the presteaming and/or pressurized impregnation, for example, to woodchips comprising substantial amounts of dense wood species (e.g., sugar maple, oak). The presteaming process may be conducted at atmospheric or substantially atmospheric pressure at a temperature of about 100° F. to about 200° F. Pressure impregnation may be conducted at a temperature of about 210° F. to about 350° F.

In an initial cooking step s105, the woodchips are treated or cooked in a first liquor where the chips are hydrolyzed. According to the methods of the present invention, the first liquor comprises substantially pure water with no alkali chemicals added to the first liquor. It is contemplated that the first liquor may contain other, non-alkali additives, including, for example, penetration aids, wettability agents, and the like. The woodchips may be cooked in a batch or a continuous digester(s). Non-limiting examples of digesters that may be used include Pandia (Kadant Black Clawson, Mason, Ohio), Bauer (Andritz AG, Graz, Austria), and Kamyr (Andritz AG, Graz, Austria) digesters. It is contemplated that other digesters may also be used. High pressure steam and water are added to the digester(s). The steam generally condenses within the digester(s). The resulting liquor to wood ratio is generally from about 1.5:1 to about 6:1. It is contemplated that the liquor to wood ratio may range from about 2:1 to about 3:1. In one process, the woodchips are cooked in the first liquor at a temperature ranging from about 320° F. to about 370° F. and a pressure ranging from about 100 psi to about 170 psi. Depending on the temperature and pressure, the woodchips are cooked in the first liquor for about 5 minutes to about 45 minutes. More specifically, the woodchips may, for example, be cooked at a temperature ranging from about 350° F. to about 360° F. for about 10 minutes to about 12 minutes. The resulting pulp generally has a pH ranging from about 3 to about 4, depending on the species and varieties of woodchips used. It may be desirable for the initial cooking step to be conducted at relatively high temperatures and pressures, thereby increasing the speed of the initial cooking step. Moreover, at a relatively high pressure, the force created upon releasing the pressure in the digester(s) may be used to blow the hydrolyzed woodchips into a defibrator or refiner at step s110.

Referring to the step s110, after the hydrolyzed woodchips are inside of the defibrator, the woodchips are exposed to hot fiberization. In one embodiment, the defibrator includes a stationary plate (stator) coupled to a rotating grinding disk (rotor), which has a grinding surface thereon. Woodchips positioned between the plate and the disk are then ground and slightly disintegrated, forming wood fibers. Steam, water, and/or a mild alkali (e.g., NaOH) may optionally be added to the defibrator, which may be pressurized or maintained at atmospheric pressure. The temperature inside of the defibrator may range from about 150° F. to about 350° F. at a consistency generally ranging from about 25% to about 35%. Consistency is a measurement of the percentage of bone dry solids by weight in the pulp. The pulp exiting the defibrator is generally mulch-like, forming fiber bundles.

In this process, the pulp is then sent to a blow tank or cyclone at step s115. Dilution liquor is added to the blow tank/cyclone. The dilution liquor may include water and/or filtrate, which may include up to about 1% alkali on a bone dry wood basis, from a proceeding dewatering/hydrolyzate extracting step s120. If the defibrator at the step s110 was pressurized, the pulp entering the blow tank/cyclone is generally depressurized, and gases are separated from the pulp. Moreover, the pulp is substantially diluted in the blow tank/cyclone such that the consistency of the pulp exiting the blow tank may range from about 2% to about 4%, depending on the type of washer within the blow tank/cyclone. The blow tank/cyclone may be pressurized, or it may be run at atmospheric pressure.

The pulp is then dewatered and washed at a temperature ranging from about 100° F. to about 210° F. at the step s120. This step may be conducted in, for example, an extraction press/impress refiner, a screw press, a multistage drum washer, a chemiwasher, a continuous digester with displacement washing, other washing and/or extracting equipment, and/or combinations thereof. During this step, hydrolyzate is extracted, separated, and recovered from the pulp, thereby thickening the pulp. The pulp is then washed, and the pH of the resulting pulp generally ranges from about 5 to about 7.

The recovered organics in the hydrolyzate and washings are then treated to remove valuable byproducts including acetic acid at step s121. The remaining organics may be used to generate methane in an anaerobic reactor. Alternatively or additionally, the remaining organics may be used to produce other energy byproducts and/or biogases including, but not limited to, ethanol, xylitol, other natural polymers, or combinations thereof.

In step s125, the pulp is treated with a solution including an alkali (e.g., $Na_2CO_3$) liquor to neutralize the pulp. Step s125 may be carried out in an extraction vessel including, but not limited to, a low to high pulp density tower, a pulp storage vessel, a stock chest, or a stand pipe at a consistency of about 5% to about 20%. The neutralization liquor generally includes up to about 50% alkali by concentration and has a temperature of about 100° F. to about 210° F. The alkali charge, expressed as $Na_2O$ on a bone dry wood basis, is about 0.5% to about 3%. The pulp is generally treated with the neutralization liquor for about 1 hour to about 4 hours. Non-limiting examples of the types of alkali that may be used in the neutralization liquor include sodium hydroxide (NaOH), sodium carbonate ($Na_2CO_3$), sodium bicarbonate ($NaHCO_3$) potassium hydroxide (KOH), potassium carbonate ($K_2CO_3$), potassium bicarbonate ($KHCO_3$), ammonium hydroxide ($NH_4OH$), and combinations thereof.

Alternatively, following step s120, the pulp may be sent to a pressurized digester including a third liquor at step s126, where the pulp undergoes mild alkalization. Steam is generally added to the pressurized digester. The alkalization step of step s126 may be conducted at about 30% to about 50% consistency in any commercial digester/impregnator including, for example, a Pandia digester. The alkalization may include treating the pulp with a mildly basic alkalization liquor including a chemical charge of from about 2% to about 4% expressed as $Na_2O$ on a bone dry wood basis and at a temperature of from about 210° F. to about 370° F. for about 1 minute to about 15 minutes at a liquor to wood ratio of about 2:1 to about 4:1. The pulp exiting the pressurized digester then enters a thickening device (e.g., a screw press) where the pulp is thickened and washed at step s127. The water used to wash the pulp at step s127 may be recycled back into the blow tank/cyclone (see step s115).

Figure 2:
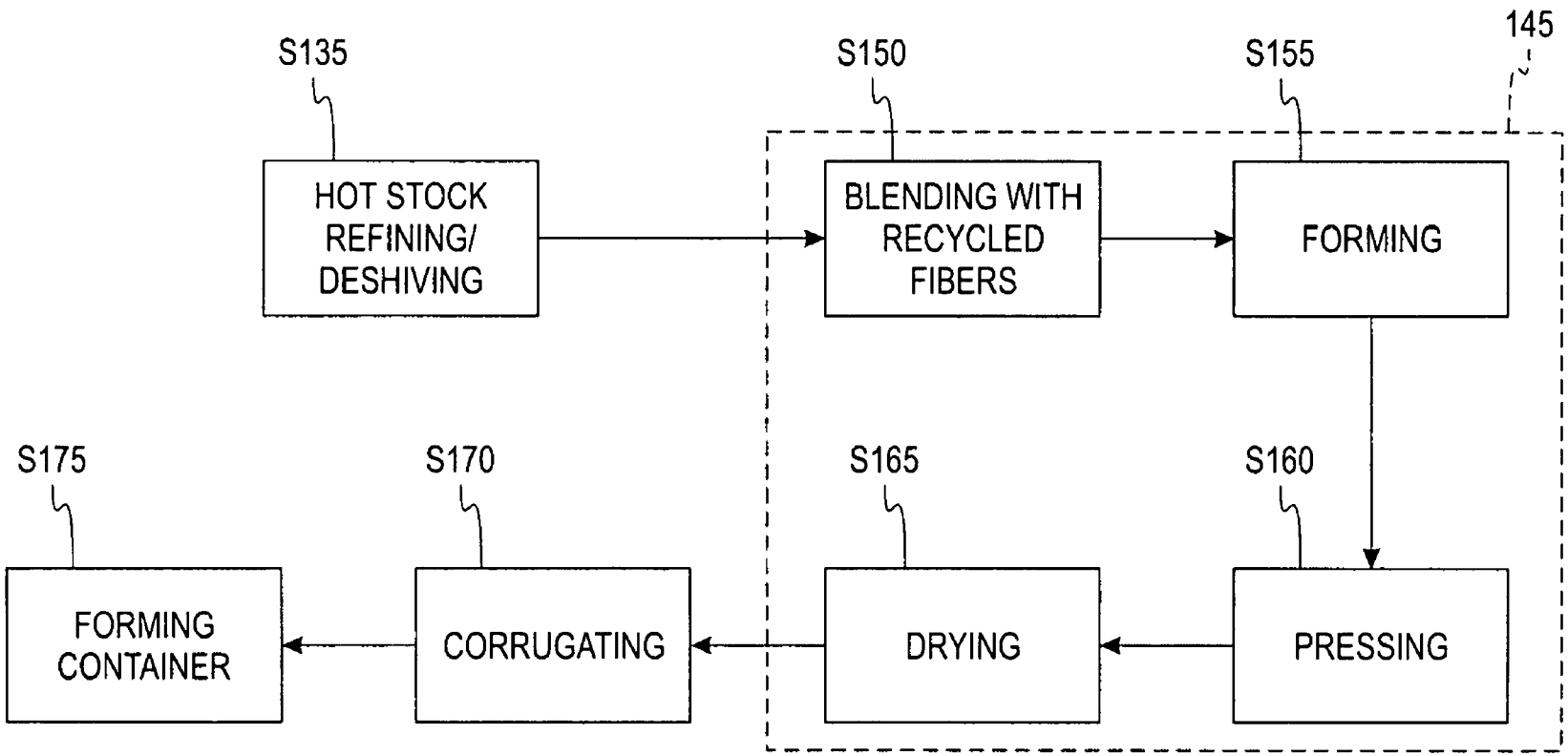
FIG. 2 is a flow diagram detailing a method of refining pulp according to another method of the present invention.

Following the neutralization step s125 or the alkalization steps s126, s127, the resulting pulp is refined to a freeness suitable for manufacturing corrugating medium at step s130 (e.g., a CSF of about 350 ml to about 500 ml). Freeness relates to the surface condition and swelling of the pulp fiber. More specifically, freeness is a measure of the rate at which a dilute suspension of pulp (e.g., 3 grams of bone dry pulp at 20° C.) is drained and may be measured according to TAPPI-227. This step may be carried out using processes generally known in the art and may include several different refining steps. One example of a suitable refining process is illustrated in FIG. 2*a*. The pulp may be refined and/or deshived in either a pressurized or an atmospheric hot stock refiner at a temperature ranging from about 100° F. to about 200° F. at step s135. During this step, the consistency of the pulp may be adjusted to about 3% to about 6%. The refined, deshived pulp has a pH ranging from about 7 to about 9. The pulp is then sent to a papermachine stock preparation system 145 where the pulp is further refined and blended with recycled fibers (step s150) including old corrugating containers, double-lined kraft clippings, or combinations thereof. The blended corrugating medium is then formed (step s155), pressed (step s160), and dried (step s165) to manufacture corrugating medium. The corrugating medium may then be corrugated, or coupled between two outer plies of linerboard, to form a corrugated board at step s170. The corrugated board may then be folded at step s175 to form at least a portion of a cardboard container or box.

The methods of the present invention simplify existing semichemical pulp processes. Unlike existing methods, which generally utilize substantial amounts of alkali in the initial cooking step, the method of the present invention uses substantially pure water as the primary cooking medium for the bulk of the digestion (step s105) and a small amount of alkali during the pulp neutralization (step s125) or alkalization step (step s126). Thus, the method of the present invention may generally use an average of less than one-fourth of the alkali used in existing pulping processes. It is contemplated that the method of the present invention generally uses from about 20% to about 30% less energy than existing processes using alkali in the primary cooking medium (e.g., the caustic and/or carbonate process). Accordingly, the need for energy and/or chemical recovery, which may be labor, energy, and/or cost intensive, is substantially reduced or eliminated.

EXAMPLE 1

Pulp was produced using the methods of the present invention at a laboratory scale using mixed hardwood chips. Pulp produced using the inventive method was compared to pulp produced using a comparative method simulating existing processes for manufacturing pulp.

For the inventive method, the hardwood chips were washed and initially cooked with substantially pure water in 2 liter batch digesters using a water to wood ratio of about 2.5:1. The cooking process included indirectly heating the digesters using cooking oil. After heating for approximately 5 minutes, a temperature of about 352° F. was obtained and maintained for about 12 minutes. The pH of the resulting woodchips was about 3.5. After cooking, the woodchips of the inventive method were transferred to a blender where hot fiberizing was conducted for about 1 minute, resulting in a wood pulp. The pulp was then washed on a laboratory apparatus. The washed pulp was then neutralized such that the pH of the washed pulp was adjusted to about 8.5 using about 0.66% NaOH on a bone dry wood basis at a temperature of about 150° F. The resultant pulp was refined at a temperature of about 150° F. in a 12" Sprout Waldron disk refiner at a consistency of about 5% until a freeness of about 700 CSF to about 750 CSF and a shive content of about 5% to about 10% was achieved. Shives may be measured using a Pulmac shive analyzer (Pulmac International, Montpelier, Vt.) and a 10-cut (0.01 inch) screen. The pulp was then dewatered to about 10% consistency and refined in a laboratory refiner (i.e., PFI mill) to a freeness of about 300 CSF.

The comparative method was a slightly modified version of the inventive method described above. The comparative method was intended to simulate existing methods of manufacturing pulp. For example, the woodchips of the comparative method were initially treated with a liquor including about 7.5% $Na_2CO_3$ on a bone dry wood basis for about 8 minutes. The remaining parameters were similar to or substantially the same as those of the inventive method described above.

Standard 26 lb/1000 $ft^2$ hand sheets were made from the resultant pulp to simulate performance of a corrugating medium. Key process parameters and pulp strength properties for the trial pulp produced using the inventive method were compared to pulp produced using the comparative method, and the results are summarized in Table 1 below.

TABLE 1

| | | Comparative (alkali cook) | Inventive (water cook) |
|---|---|---|---|
| Cooking temperature (° F.) | | 355 | 352 |
| Percent $Na_2CO_3$ on bone dry wood used in initial cooking step | | 7.5 | 0 |
| Percent NaOH on bone dry pulp used for pH adjustment | | 0 | 0.8 |
| Cooking time (minutes) | | 8 | 12 |
| pH of woodchips after cooking | | 9 | 3.5 |
| Liquor to wood ratio | | 2.2:1 | 2.5:1 |
| Refining energy (Wh) | | 31.3 | 23.9 |
| | TAPPI Test Method Numbers | | |
| Drainage time (seconds) | T221 | 9.2 | 8.8 |
| Porosity (Gurley) | T460 | 11.7 | 11.5 |
| Tensilestrength (lb/in) | T460 | 22.1 | 21.1 |
| Tear resistance (gf) | T494 | 43.8 | 40.4 |
| Ring crush (lb) | T822 | 47.0 | 45.8 |
| CMT (lb) | T809 | 40.2 | 39.5 |

Refining energy is the energy to beat 20 grams of bone dry pulp to a given freeness using laboratory beating equipment such as a PFI mill. The refining energy of the comparative process (31.3 Wh) was significantly higher than that of the inventive process (23.9 Wh).

Drainage rate is the time required to form a standard hand sheet at 20° C. weighing 60 g/m$^2$ adopted to 26 lb/1000 ft$^2$ on a bone dry paper basis, which is a slight adaptation of the standard TAPPI procedure. The drainage rate of the comparative process (9.2 seconds) was comparable to that of the inventive process (8.8 seconds).

Porosity, or air resistance, is an indirect indicator of the degree of beating, absorbency, specific gravity, and filtering efficiency of the pulp. More specifically, the porosity is the time required for a specific volume of air to pass through a given area of paper specimen. A Gurley-type of apparatus or machine was used on 26 lb/1000 ft$^2$ of bone dry paper specimen.

Tensile strength is a tensile breaking property and represents a force per unit width required to break a specimen. A paper specimen of 26 lb/1000 ft$^2$ of bone dry paper was tested.

Tear or tearing resistance is the force, applied perpendicularly to a plane of paper, required to tear multiple sheets of paper a specified distance after the tear has been started using an Elmendorf-type tearing tester. Three plies of 26 lb/1000 ft$^2$ of bone dry paper specimen were used.

Ring crush or resistance is a measure of the compressive force required to be exerted on a paper specimen held in a ring form in a special jig and placed between two plates of a compression machine for the specimen to collapse. 26 lb/1000 ft$^2$ of bone dry paper specimen was used.

The Concora medium test (CMT), or flat crush resistance, measures the rigidity of a fluted structure of corrugated board. CMT provides a means of estimating, in a laboratory setting, the potential flat crush resistance of corrugated board. CMT measures the amount of force exerted on a lab-fluted strip of paper, which is crushed between the plates of a CMT testing machine. 26 lb/1000 ft$^2$ of bone dry paper specimen was used.

Hand sheets made from pulp produced using the inventive method compared favorably with the hand sheets made from pulp produced using the comparative method. For example, the comparative hand sheets had a tensile strength value of 22.1, and the trial hand sheets had a tensile strength value of 21.1. Other properties (e.g., tear resistance, ring crush, and CMT) of the trial hand sheets were also comparable to the comparative hand sheets.

EXAMPLE 2

A second laboratory simulation of the proposed invention was also conducted using a method similar to that of Example 1 above. The methods of Example 2, however, were performed at higher cooking temperatures, a higher charge of $Na_2CO_3$ (i.e., 10% on a bone dry wood basis) in the comparative cooking step, and shorter cooking times. Again, the pulp produced using the inventive method of the present invention was compared to pulp produced using a comparative method, which was intended to simulate existing pulping processes on the same chip blend. The cooking, fiberizing, washing, alkalization, and refining procedures were similar to those employed for Example 1.

Standard 26 lb/1000 ft$^2$ hand sheets were made from the resultant pulp to simulate performance of a corrugating medium. Key process parameters and pulp strength properties for the trial pulp produced using the inventive method were compared to pulp produced using the comparative method, and the results are summarized in Table 2 below.

TABLE 2

| | | Comparative (alkali cook) | Inventive (water cook) |
|---|---|---|---|
| Cooking temperature (° F.) | | 370 | 350 |
| Percent $Na_2CO_3$ on bone dry wood used in initial cooking step | | 10 | 0 |
| Percent NaOH on bone dry pulp used for pH adjustment | | 0 | 0.8 |
| Cooking time (minutes) | | 4 | 12 |
| Liquor to wood ratio | | 2.1:1 | 2.5:1 |
| Refining energy (Wh) | | 30.4 | 26.7 |
| | TAPPI Test Method Numbers | | |
| Drainage time (seconds) | T221 | 10.0 | 9.9 |
| Porosity (Gurley) | T460 | 17.1 | 20.3 |
| Tensile strength (lb/in) | T460 | 23.4 | 23.2 |
| Tear resistance (gf) | T494 | 49.9 | 44.6 |
| Ring Crush (lb) | T822 | 48.8 | 47.2 |
| CMT (lb) | T809 | 38.8 | 40.4 |

The hand sheets made from pulp produced using the inventive method again compared favorably with the hand sheets made from pulp produced using the comparative method. For example, the tensile strength of the comparative hand sheet was 23.4, and the tensile strength of the trial hand sheet was 23.2. Other properties (e.g., tear resistance, ring crush, and CMT) of the trial hand sheets were also comparable to the comparative hand sheets.

EXAMPLE 3

A laboratory simulation including a slight modification of Example 2 was also conducted using mixed hardwood chips. The inventive method of Example 3 included two separate stages. During stage I, the woodchips were cooked with water at about 340° F. for about 15 minutes. The woodchips were then fiberized to form trial pulp, and the hydrolyzate was recovered by pressing, as described with respect to Example 1 above. Stage II of the inventive process included treating the resultant trial pulp with about 4.1% sodium carbonate on a bone dry wood basis at about 263° F. for about 5 minutes, washing, and refining as described with respect to Example 1 above.

The comparative method of Example 3 included cooking the woodchips in a liquor comprising a chemical charge of about 10% $Na_2CO_3$ on a bone dry wood basis for about 4 minutes at a temperature of about 370° F. The woodchips were not treated with a second liquor during the comparative method.

Standard 26 lb/1000 $ft^2$ hand sheets were made from the resultant pulp to simulate performance of a corrugating medium. Key process parameters and pulp strength properties for the trial pulp produced using the inventive method were compared to pulp produced using the comparative method, and the results are summarized in Table 3 below.

TABLE 3

| | | Comparative (alkali cook) | Inventive (water cook) |
|---|---|---|---|
| Stage I | | | |
| Cooking temperature (° F.) | | 370 | 340 |
| Percent $Na_2CO_3$ on bone dry wood | | 10 | 0 |
| Cooking time (minutes) | | 4 | 15 |
| Liquor to wood ratio | | 2.5:1 | 2.5:1 |
| Stage II | | | |
| Treating temperature (° F.) | | — | 263 |
| Percent $Na_2CO_3$ on bone dry wood | | — | 4.1 |
| Treating time (minutes) | | — | 5 |
| Liquor to wood ratio | | — | 2.5:1 |
| | TAPPI Test Method Numbers | | |
| Porosity (Gurley) | T460 | 18.8 | 23.7 |
| Tensile strength (lb/in) | T494 | 23.2 | 23.5 |
| Ring Crush (lb) | T822 | 47.6 | 46.9 |
| CMT (lb) | T809 | 38.9 | 40.6 |

The hand sheets made from pulp produced using the inventive method again compared favorably with the hand sheets made from pulp produced using the comparative method. For example, the tensile strength of the comparative hand sheet was 23.2, and the tensile strength of the trial hand sheet was 23.5. Other properties (e.g., porosity, ring crush, and CMT) of the trial hand sheets were also comparable to the comparative hand sheets.

EXAMPLE 4

Pulp was also produced using the methods of the present invention at a commercial scale. For example, a mill trial was conducted to validate the method of the present invention and to evaluate whether the corrugating medium produced using pulp made using the present method was of commercial grade. The mill digesters used for cooking the woodchips in Example 4 included four tiers or chambers. The woodchips entered the digester through a top chamber and exited the digester through a bottom chamber.

During the inventive method of Example 4, mixed hardwood chips were positioned in a mill digester and cooked in a liquor including substantially pure water at about 355° F. for about 12 minutes. Additional parameters are provided in Table 4a below. The pulp from the mill digester was then diluted with water and sent to a chemiwasher to recover the hydrolyzate. About 0.9% to about 1.2% NaOH on a bone dry wood basis was added to the pulp at the discharge of the chemiwasher, and the pulp was then transferred into a stock chest at atmospheric conditions where the pulp soaked in the caustic solution for approximately 2 hours. The pulp was then refined by primary and secondary stage refiners prior to being blended with secondary fiber and broke in the blend chest. Once blended, the stock was refined a final time by tickler refiners and sent directly to a papermachine. Because the mill trial was of relatively short duration, the refining could not be optimized.

The woodchips of the comparative method were initially cooked in a liquor including about 10% $Na_2CO_3$ on a bone dry wood basis for about 4-5 minutes at a temperature of about 369-375° F.

The pulp produced using commercial scale equipment was blended with recycled fiber and used to produce a trial corrugating medium on a papermachine. The corrugating medium was converted on several commercial corrugators. Key process parameters and pulp strength properties for the pulp produced using the inventive method (trial pulp) and the comparative method (comparative pulp) were compared, and the results are summarized in Table 4 below.

TABLE 4

| | | Inventive (water cook) | Comparative (alkali cook) |
|---|---|---|---|
| Estimated Production Rate of oven-dried tons of pulp per day (ODTPD) | | 130 | 343 |
| Total Retention Time (minutes) | | 11.6 | 4-5 |
| $Na_2CO_3$ (% on a bone dry wood basis) | | 0 | 10 |
| Steam Pressure (psi) | | 125 | 170 |
| Top Chamber Temperature (° F.) | | 354-355 | 375 |
| Bottom Chamber Temperature (° F.) | | 354-355 | 369 |
| Test Parameter | TAPPI Test Method Numbers | 23 lb/1000 $ft^2$ | 23 lb/1000 $ft^2$ |
| Porosity (Sheffield) | T460 | 180 | 210 |
| MD Tensile strength (lb/in) | T494 | 34.5 | 36.6 |
| CD Tensile strength (lb/in) | T494 | 14.0 | 14.7 |
| CD Tear (gf) | T414 | 86.0 | 90.6 |
| Ring Crush (lb) | T822 | 34.4 | 33.7 |
| CMT (lb) | T809 | 50.3 | 51.1 |

The quality and physical properties of the corrugating medium produced from the trial pulp was also comparable to the corrugating medium produced from the comparative pulp, although the tear resistance was slightly lower. The corrugating medium was then converted on three different corrugators to produce corrugating boxes. There were no problems encountered, and the final properties of the finished product were similar to those produced using existing processes.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A method of manufacturing a corrugating medium, the method comprising the acts of:

providing a first liquor that is not acidic or alkaline in nature;

providing woodchips comprising wood fibers;

cooking the woodchips in the first liquor, such that a pH of about 3 to about 4 is obtained after said cooking;

prior to separating hydrolyzate, mechanically fiberizing the woodchips at a pH of about 3 to about 4 to form a pulp;

subsequently adding a dilution liquor to the pulp, the dilution liquor including at least one alkali;

thereafter separating hydrolyzate from the pulp;

treating the pulp with a second liquor, the second liquor including a second at least one alkali;

refining the pulp;

blending the pulp with recycled fibers to form a blended pulp; and forming the corrugating medium using the blended pulp.

2. The method of claim 1, wherein the recycled fibers include old corrugating containers, double-lined kraft clippings, or combinations thereof.

3. The method of claim 1, wherein the ratio of the first liquor to woodchips is from about 1.5:1 to about 6:1.

4. The method of claim 1, wherein the first liquor has a temperature ranging from about 320° F. to about 370° F. and the woodchips are cooked in the first liquor for about 5 to about 45 minutes.

5. The method of claim 1, wherein the act of cooking the woodchips in the first liquor is conducted in a batch digester or a continuous digester.

6. The method of claim 1, wherein the act of mechanically fiberizing the woodchips is conducted in a mechanical defibrator at a consistency of from about 25% to about 35%.

7. The method of claim 1, wherein the act of separating hydrolyzate from the pulp is conducted in an extraction press/impress refiner, a screw press, a drum washer, a chemiwasher, or a continuous digester with displacement washing.

8. The method of claim 1, wherein the second at least one alkali in the second liquor includes a hydroxide, a carbonate, or a combination thereof.

9. The method of claim 8, wherein the second at least one alkali in the second liquor includes sodium hydroxide, sodium carbonate, sodium bicarbonate, potassium hydroxide, potassium carbonate, potassium bicarbonate, ammonium hydroxide, or combinations thereof.

10. The method of claim 1, wherein the temperature of the second liquor ranges from about 210° F. to about 370° F.

11. The method of claim 1, wherein the act of refining the pulp is conducted at a temperature ranging from about 100° F. to about 210° F. and a consistency of about 3% to about 6%.

12. The method of claim 1, wherein the act of refining the pulp includes obtaining a csf (freeness) from about 350 ml to about 500 ml.

13. The method of claim 1 further comprising, prior to the act of cooking the woodchips in the first liquor, presteaming the woodchips.

14. The method of claim 1 further comprising, prior to the act of cooking the woodchips in the first liquor, washing the woodchips.

15. The method of claim 1 further comprising, prior to the act of cooking the woodchips in the first liquor, exposing the woodchips to pressurized impregnation.

16. The method of claim 1, wherein the first liquor is water.

17. The method of claim 16, wherein the first liquor further includes a penetration aid.

18. The method of claim 16, wherein the first liquor further includes a wettability agent.

19. The method of claim 16, wherein the woodchips comprises hard wood fibers.

20. The method of claim 1, wherein the woodchips consist essentially of wood fibers.

21. A method of manufacturing a corrugated board, the method comprising the acts of:

providing a first liquor that is not acidic or alkaline in nature;

providing woodchips comprising wood fibers;

cooking the woodchips in the first liquor, such that a pH of about 3 to about 4 is obtained after said cooking;

prior to separating hydrolyzate, mechanically fiberizing the woodchips at a pH of about 3 to about 4 to form a pulp;

subsequently adding a dilution liquor to the pulp, the dilution liquor including at least one alkali;

thereafter separating hydrolyzate from the pulp;

treating the pulp with a second liquor, the second liquor including a second at least one alkali;

refining the pulp;

blending the pulp with recycled fibers to form a blended pulp;

forming the corrugating medium using the blended pulp; and coupling the corrugating medium between a first outer ply and a second outer ply of linerboard to form a corrugated board.

22. The method of claim 21, wherein the recycled fibers include old corrugating containers, double-lined kraft clippings, or combinations thereof.

23. The method of claim 21 further comprising, prior to the act of cooking the woodchips in the first liquor, presteaming the woodchips.

24. The method of claim 21 further comprising prior to the act of cooking the woodchips in the first liquor, washing the woodchips.

25. The method of claim 21 further comprising prior to the act of cooking the woodchips in the first liquor, exposing the woodchips to pressurized impregnation.

26. The method of claim 21, wherein the first liquor is water.

27. The method of claim 26, wherein the first liquor further includes a penetration aid.

28. The method of claim 26, wherein the first liquor further includes a wettability agent.

29. The method of claim 21, wherein the woodchips comprises hard wood fibers.

30. The method of claim 21, wherein the woodchips consist essentially of wood fibers.

31. A method of manufacturing a corrugating medium, the method comprising the acts of:

providing a first liquor, the first liquor being water in the absence of an acidic or alkali addition;

providing woodchips comprising wood fibers;

cooking the woodchips in the first liquor, such that a pH of about 3 to about 4 is obtained after said cooking;

prior to separating hydrolyzate, mechanically fiberizing the woodchips at a pH of about 3 to about 4 to form a pulp;

subsequently adding a dilution liquor to the pulp, the dilution liquor including at least one alkali;

thereafter separating hydrolyzate from the pulp;

treating the pulp with a second liquor, the second liquor including a second at least one alkali;

refining the pulp; and forming the corrugating medium using the refined pulp.

32. The method of claim 31 further comprising, prior to the act of cooking the woodchips in the first liquor, presteaming the woodchips.

33. The method of claim 31 further comprising prior to the act of cooking the woodchips in the first liquor, washing the woodchips.

34. The method of claim 31, wherein the first liquor further includes a penetration aid.

35. The method of claim 31, wherein the woodchips comprises hard wood fibers.

36. The method of claim 31, wherein the woodchips consist essentially of wood fibers.

37. A method of manufacturing a corrugating board, the method comprising the acts of:

providing a first liquor, the first liquor being water in the absence of an acidic or alkali addition;

providing woodchips comprising wood fibers;

cooking the woodchips in the first liquor, such that a pH of about 3 to about 4 is obtained after said cooking;

prior to separating hydrolyzate, mechanically fiberizing the woodchips at a pH of about 3 to about 4 to form a pulp;

subsequently adding a dilution liquor to the pulp, the dilution liquor including at least one alkali;

therafter separating hydrolyzate from the pulp;

treating the pulp with a second liquor, the second liquor including a second at least one alkali;

refining the pulp;

forming corrugating medium using the refined pulp; and forming the corrugated board using the corrugating medium.

38. The method of claim 37, wherein the corrugating board further includes linerboard.

39. The method of claim 37, wherein the woodchips consist essentially of wood fibers.

40. A method of forming and treating a hydrolyzate, the method comprising the acts of:

providing a first liquor that is not acidic or alkaline in nature;

providing woodchips comprising wood fibers;

cooking the woodchips in the first liquor;

prior to removing hydrolyzate, mechanically fiberizing the woodchips to form a pulp;

subsequently adding a dilution liquor to the pulp, the dilution liquor including at least one alkali;

thereafter separating the hydrolyzate from the pulp;

treating the hydrolyzate so as to produce acetic acid, ethanol, xylitol, natural polymers, a biogas comprising methane, or combinations thereof; and forming a corrugating medium with the pulp.

41. The method of claim 40, wherein the first liquor is water.

42. A method of forming and treating a hydrolyzate, the method comprising the acts of:

providing a first liquor, the first liquor being water in the absence of an acidic or alkali addition;

providing woodchips comprising wood fibers;

cooking the woodchips in the first liquor, such that a pH of about 3 to about 4 is obtained after said cooking;

prior to separating hydrolyzate, mechanically fiberizing the woodchips at a pH of about 3 to about 4 to form a pulp;

subsequently adding a dilution liquor to the pulp, the dilution liquor including at least one alkali;

thereafter separating the hydrolyzate from the pulp;

treating the hydrolyzate so as to produce acetic acid, ethanol, xylitol, natural polymers, a biogas comprising methane, or combinations thereof; and forming a corrugating medium with the pulp.

* * * * *